US008544407B2

(12) United States Patent
Spray

(10) Patent No.: US 8,544,407 B2
(45) Date of Patent: Oct. 1, 2013

(54) ATTACHMENT MODULE FOR A SAFETY CONE

(76) Inventor: David Allen Spray, Huntsville, AL (US)

( * ) Notice: Subject to any disclaimer, the term of this patent is extended or adjusted under 35 U.S.C. 154(b) by 342 days.

(21) Appl. No.: 13/013,597

(22) Filed: Jan. 25, 2011

(65) Prior Publication Data

US 2012/0186511 A1 Jul. 26, 2012

(51) Int. Cl.
*E01F 9/012* (2006.01)
*G09F 7/18* (2006.01)

(52) U.S. Cl.
USPC ..... 116/63 C; 40/611.05

(58) Field of Classification Search
USPC .. 116/63 C, 63 P, 63 T, 173, 174; 40/611.05, 40/611.12, 612; 248/535, 536, 539, 540, 248/541; 404/9, 10; D10/113.1, 113.2, 113.3, D10/113.4
See application file for complete search history.

(56) References Cited

U.S. PATENT DOCUMENTS

| | | | | | |
|---|---|---|---|---|---|
| 2,191,075 | A | * | 2/1940 | Hogan | 248/541 |
| 3,920,207 | A | * | 11/1975 | Adamaitis | 248/538 |
| 4,250,664 | A | * | 2/1981 | Remke | 47/76 |
| D266,653 | S | | 10/1982 | Cho | |
| 4,782,783 | A | | 11/1988 | Kulp et al. | |
| 4,925,334 | A | | 5/1990 | Beard | |
| 5,098,051 | A | * | 3/1992 | Aldridge et al. | 248/230.9 |
| 5,236,751 | A | | 8/1993 | Martin et al. | |
| 5,269,251 | A | | 12/1993 | Freeman | |
| 5,485,700 | A | | 1/1996 | Van Vranken | |
| 5,577,824 | A | | 11/1996 | Wright | |
| 5,755,174 | A | * | 5/1998 | Freeman | 116/63 C |
| 5,888,016 | A | | 3/1999 | Ahn | |
| 5,966,865 | A | * | 10/1999 | Jones | 47/41.01 |
| 5,993,105 | A | | 11/1999 | Chan | |
| 6,053,657 | A | | 4/2000 | Signorelli | |
| 6,099,203 | A | | 8/2000 | Landes | |
| 6,338,212 | B1 | * | 1/2002 | Santa Cruz et al. | 40/607.12 |
| 6,378,820 | B1 | * | 4/2002 | Mooney et al. | 248/218.4 |
| 6,448,902 | B1 | | 9/2002 | Tung | |

(Continued)

FOREIGN PATENT DOCUMENTS

| | | | |
|---|---|---|---|
| EP | 2353488 | A1 * | 8/2011 |
| GB | 2401897 | A * | 11/2004 |

(Continued)

OTHER PUBLICATIONS

The Traffic Safety Store, WEB Document, printed Jul. 12, 2006.

(Continued)

*Primary Examiner* — R. A. Smith
(74) *Attorney, Agent, or Firm* — James Richards

(57) ABSTRACT

An attachment module for a safety cone permitting a variety of safety enhancing devices to be easily attached to the cone. The attachment module comprising a top ring and a bottom ring joined together to form an assembly. The top ring and bottom ring sized to conform to a predefined safety cone angle or range of angles, the assembly having an attachment arm for attaching a safety-enhancing device. Examples of safety enhancing devices include, but are not limited to a flag, a sign, a safety tape holder, a light, or other safety-enhancing device. The assembly may be placed over a safety cone and is held secure by gravity and the wedge of the cone angle. Safety enhancing devices may then be attached to the module and thus to the cone to improve the effectiveness of the cone.

10 Claims, 6 Drawing Sheets

(56) References Cited

U.S. PATENT DOCUMENTS

| | | | | |
|---|---|---|---|---|
| 6,708,832 | B1 * | 3/2004 | Hannon | 211/107 |
| 7,810,265 | B2 * | 10/2010 | Beatty | 40/607.14 |
| 2002/0179804 | A1 | 12/2002 | Graves et al. | |
| 2004/0218381 | A1 | 11/2004 | Sawyer et al. | |

FOREIGN PATENT DOCUMENTS

| | | | | |
|---|---|---|---|---|
| JP | 2011237745 | A | * | 11/2011 |
| JP | 3181314 | U | * | 1/2013 |
| WO | WO 99/33526 | | | 7/1999 |

OTHER PUBLICATIONS

Traffic and Parking Control (TAPCCO), WEB document, printed Jul. 12, 2006.

MARPAC, WEB document, printed Jul. 13, 2006.

Chief Supply Company, WEB document, printed Jul. 13, 2006.

* cited by examiner

ATTACHMENT MODULE FOR A SAFETY CONE

FIELD OF THE INVENTION

The present invention pertains generally to the field of traffic safety, more particularly to systems for attaching safety enhancing devices to a safety cone.

BACKGROUND OF THE INVENTION

Safety cones are typically used to mark a hazard or to delineate a safe or orderly path of travel, to mark a parking space, to regulate traffic, or other purpose. The cones are made of a highly visible material or painted a highly visible color, typically daylight fluorescent orange "safety orange". The cones come in a full range of sizes, large sizes the size of an oil drum to small sizes easily stowed in a trunk. Safety cones are a convenient shape that lends itself to efficient stacking for storage, allowing several cones to be stored in a car trunk, or allowing many cones to be easily deployed and retrieved from a single vehicle. In addition to safety cones, additional safety devices such as signs, flags, tapes, and lights are often deployed in conjunction with safety cones to further clarify the message and reason for the deployment of the safety cones. Thus, the art of safety marking and management is in constant need for improvements in effectiveness, cost effectiveness, convenience and capability.

BRIEF DESCRIPTION OF THE INVENTION

The present invention relates to an attachment module for a safety cone permitting a variety of safety enhancing devices to be easily attached to the cone. The attachment module comprises a top ring and a bottom ring joined together to form an assembly. The top ring and bottom ring are sized to conform to a predefined safety cone angle or range of angles. The assembly includes an attachment arm for attaching a safety-enhancing device. Examples of safety enhancing devices include, but are not limited to a flag, a sign, a safety tape holder, a light, or other safety-enhancing device. The assembly may be placed over a safety cone and is held secure by gravity and the wedge of the cone angle. Safety enhancing devices may then be attached to the module and thus to the cone to improve the effectiveness of the cone.

In one embodiment, the connecting structure is attached to the upper ring and attached to the lower ring, the connecting structure providing a separation distance between the first ring and the second ring in accordance with the first diameter and the second diameter and the predetermined cone angle.

In one embodiment, an attachment arm is attached to the connecting structure, the attachment arm is capable of receiving a rod shaped attachment feature from the safety enhancement device for mounting the safety enhancement device on the attachment module.

In one embodiment, the attachment arm has a mounting hole having a mounting hole axis, the mounting hole axis having a vertical directional component.

In a further embodiment, the attachment arm is capable of providing rotational stability relative to the mounting hole axis.

In a further embodiment, the attachment arm requires no fasteners to attach the safety enhancing device.

In a further embodiment, the ring may form a round, a triangle, a square, a hexagon, or a polygon shape.

In other embodiments, the invention may include a safety enhancing device having a rod shaped mounting feature attached to the safety enhancing device for mounting the safety enhancing device on the attachment module.

In further embodiments, the safety enhancing device may include at least one flange attached to the safety enhancing device, the flange disposed parallel to the rod shaped mounting feature, the flange configured to be close fitting to the mounting arm to establish a unique orientation of the safety enhancing device when mounted on the attachment module.

In a further embodiment, the at least one flange forms part of a channel shaped mounting feature, the channel shaped mounting feature configured to be close fitting to the mounting arm to establish a unique orientation of the safety enhancing device when mounted on the attachment module.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1:
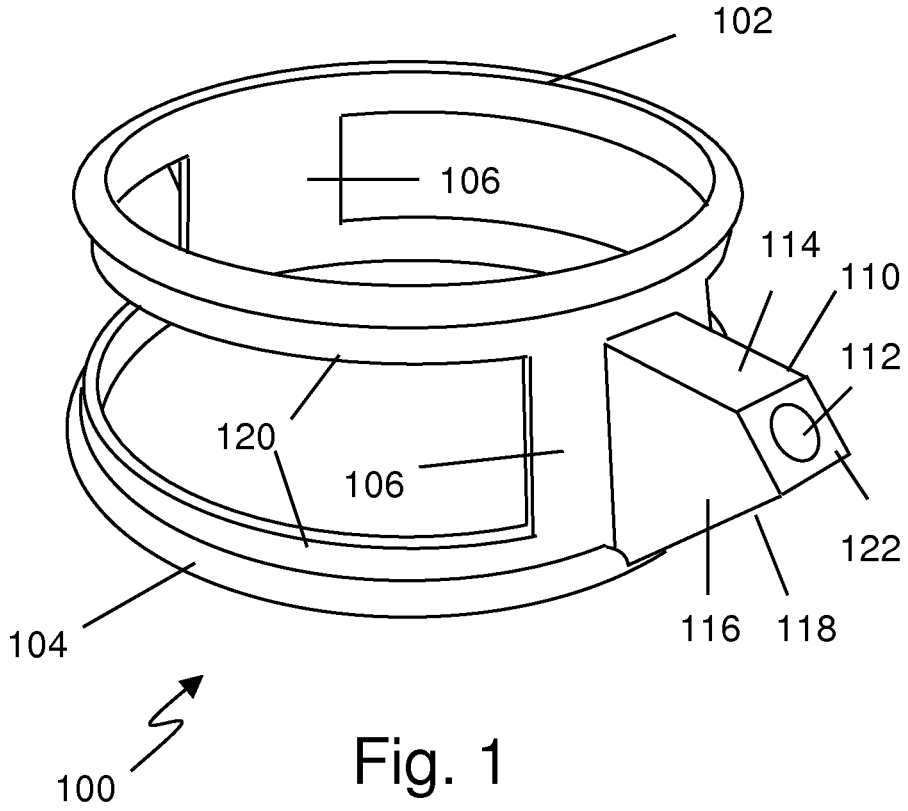
FIG. 1 illustrates an isometric view of an exemplary safety cone attachment module in accordance with the present invention.

FIG. 1 illustrates an isometric view of an exemplary safety cone attachment module in accordance with the present invention. Referring to FIG. 1, the attachment module 100 comprises a base comprising an upper ring 102 and a lower ring 104 spaced by a spacing structure 106. An attachment arm 110 is mounted on the spacing structure 106. The attachment arm 110 is adapted to receive mounting features of a safety enhancing device.

More generally, the attachment module 100 comprises a structure having a base conformal to a nominal safety cone and providing stability from tipping vertically front to back or side to side. The base rests on the cone held in place by gravity and friction between the cone and the contact surface of the base with the cone. The base allows rotation around the vertical axis of the cone for positioning the attachment module.

The exemplary base of FIG. 1 comprises two rings, a top ring 102 and a bottom ring 104, each having a radius corresponding to an upper and lower elevation cross section of the cone. The top and bottom rings 102, 104 are separated by at least one and preferably two spacing structures 106. Any number of spacing structures 106 may be used. The rings are shown to have additional flanges 120 for added strength and support. Alternatively, the flanges may be extended to fill the entire space between the two rings, forming a conformal conical segment having the same cone angle as the traffic cone. The attachment module 100 further comprises one or more attachment arms 110 attached to the spacing structures 106. The attachment arms provide attachment features for attaching safety devices to the attachment module and thus to the safety cone, when the attachment module is installed on the safety cone.

The exemplary rings 102, 104 provide contact with the cone at an upper and lower point on opposite sides of the cone for lateral stability and provide contact at an upper and lower point on both sides of the cone front and back for forward/backward tilt stability. The rings further provide contact all around the cone at two levels to achieve front to back, and side to side tilt stability. The rings shown are round, alternatively, the rings may form squares, triangles, hexagons, octagons, or other polygons to provide the desired contact that yields the desired front/back and side to side stability. Further, the rings 102, 104 may be flexible, such as rubber bands, allowing compressed storage and variable cone angle. The rings may be molded with the spacing structure 106 as one unitary body, or may be fabricated separately from the spacing structure 106 and attached to the spacing structure 106.

As shown, the spacing structures 106 have mounting protrusions 110 (alternatively referred to as mounting arms or arms) capable of providing vertical, lateral, and rotational stability for items attached thereto. The mounting arms 110 are typically used to attach safety enhancing items including but not limited to flags, signs, lights, tape holders, and other devices. The mounting arms 110 are fixedly attached to the spacing structures 106 (alternatively referred to as spacing flanges) and may be molded with the structures 106 to form a single unitary assembly. The mounting arms 110 comprise a body 114 extending outwardly from the mounting flange 106 forming a generally triangular vertical cross section. The arms have vertical flat sides 116. The arms 110 have a mounting hole 112 for receiving a mounting feature of a safety device. The sides 116 and bottom surface 118 may be formed parallel to the mounting hole 112 for cooperation with parallel mounting flanges of the safety device. The hole 112 center axis (see 502 FIG. 5*a*) and mounting arm bottom surface 118 are shown at a predetermined mounting angle. The predetermined mounting angle may be a desired angle for mounting a flag pole directly in the mounting hole. The mounting hole 112 opens at a mounting hole face surface 122, typically perpendicular to the mounting hole axis.

Figure 2:
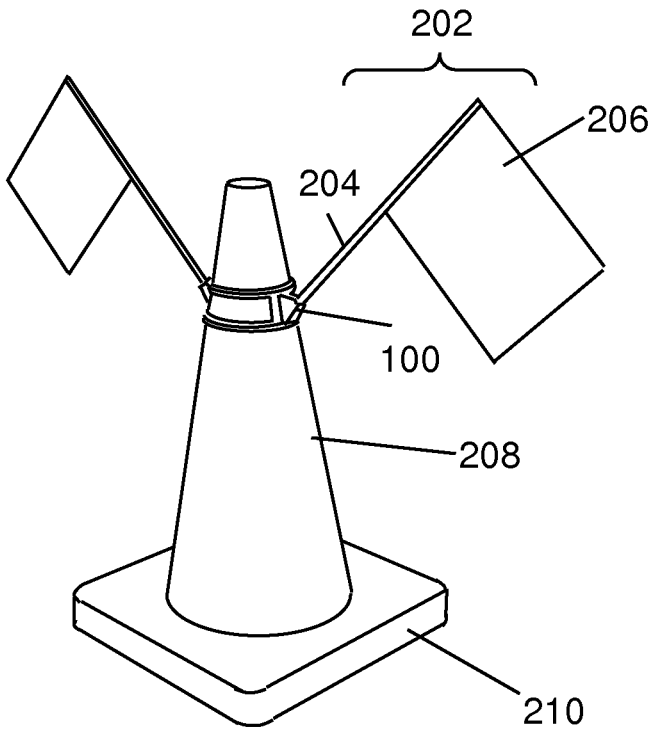
FIG. 2 illustrates the safety cone attachment module used with flags for increasing the visibility of the cone.

FIG. 2 illustrates the safety cone attachment module used with flags for increasing the visibility of the cone. Referring to FIG. 2, FIG. 2 shows the attachment module 100 used for attaching safety flags 202 to a safety cone 208. The safety flags comprise a flag pole 204 and a flag 206. The safety cone comprises a cone body 208 and a base 210. The attachment module 100 is placed on the cone 208 and the flags 202 are inserted into the mounting hole 112 of the attachment arms 110 of the attachment module. For the flag embodiment, the mounting hole center axis may be selected as the desired angle for mounting the flag pole 204. The mounting hole angle may be any angle suitable for mounting a flag pole. The exemplary angle shown is 45 degrees relative to the vertical axis of the cone. The flag pole axis is typically oriented in a plane through the center axis of the cone. A flag pole inserted into the flag pole mounting hole 112 does not usually need to be stabilized for rotation. Thus, a round hole is sufficient for the flag pole. Alternative hole shapes, such as triangular, square, hexagonal, spline, or other shape may also be used; however, a round hole is typically the simplest to fabricate and results in lowest cost.

Figure 3:
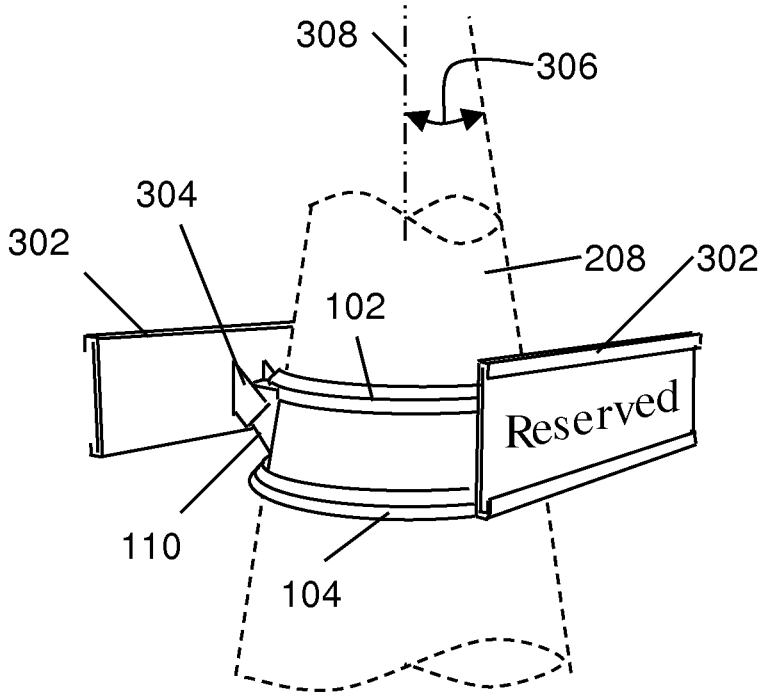
FIG. 3 illustrates an exemplary detachable sign in position on the attachment module in accordance with the present invention.

FIG. 3 illustrates an exemplary detachable sign in position on the attachment module in accordance with the present invention. Typical signs that may be provided may include "Reserved," "Caution," "Hazard," "Help," or other message that may clarify the reason for the cone. The mounting arms have flat sides 116 that may be used to stabilize and fix the vertical axis of devices mounted thereon. For various devices, for example a traffic or information sign, the mounting may need to be stabilized (prevented from rotating around the mounting axis) for best legibility and clear intent. (Rotation would permit the sign to hang at undesirable tilt angles.) An exemplary sign holder is shown in FIG. 3 that takes advantage of the flag mounting hole in combination with the associated flat sides to ensure vertical and horizontally stable and rigid mounting for the sign. The mounting of the sign, as with the mounting of the flag, does not depend on fasteners. Gravity along with incidental or, in one embodiment, intentional friction is sufficient to hold the sign in the attachment arm.

Referring to FIG. 3, FIG. 3 shows two signs 302 mounted on the attachment arms 110 of the attachment module 100 (The upper ring 102 and lower ring 104 are visible.) The rear sign 302 shows mounting flanges 304 coupled to the mounting arm 110 to fix the position of the sign.

Also in FIG. 3, the cone 208 is shown for reference, the center axis 308 of the cone is shown along with an extension line following an edge of the cone. A cone angle 306 is shown as being measured between the side of the cone 208 and the center line axis of symmetry 308 of the cone. A typical cone angle 306 may be, for example, ten degrees. Most traffic cones are built within a narrow range of angles 306 such that a base designed for matching a nominal cone angle will likely work for a significant number of different traffic cones.

Figure 4:
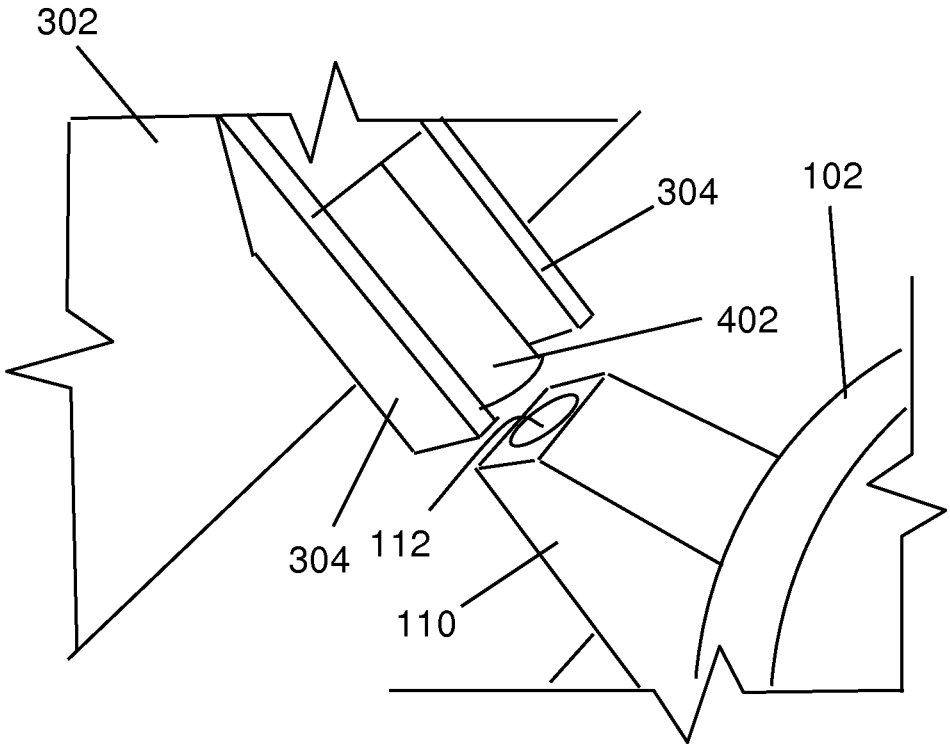
FIG. 4 illustrates a detail isometric view of the attachment arm of FIG. 3.

FIG. 4 illustrates greater detail with respect to the coupling of the sign to the attachment arm of FIG. 3. FIG. 4 shows the sign and mounting features adapted for mounting the sign on the mounting arm of the attachment module. The sign mounting features comprise a mounting rod 402 that fits in the mounting hole 112 of the mounting arm 110 and alignment flanges 304 that cooperate with the sides of the mounting arm 110 to ensure a unique orientation of the sign 302 when mounted on the mounting arm 110. The alignment flanges 304 contact or nearly contact the associated sides of the mounting arm 110 to restrict any rotation of the sign 302 that may be permitted by the mounting rod 402 alone. Two alignment flanges 304 are visible in the drawing. (The alignment flanges 304 may be alternatively referred to as strips.) A third flange behind the rod 402 in the view of FIG. 4 and joining the two visible alignment flanges 304 may also be provided. One flange may be sufficient, two would increase the stability. All three flanges joined together into a channel will provide the greatest strength and stability. The flanges 304 are fixedly attached to the sign and optionally may be molded with the sign as a unitary assembly.

Figure 5A:
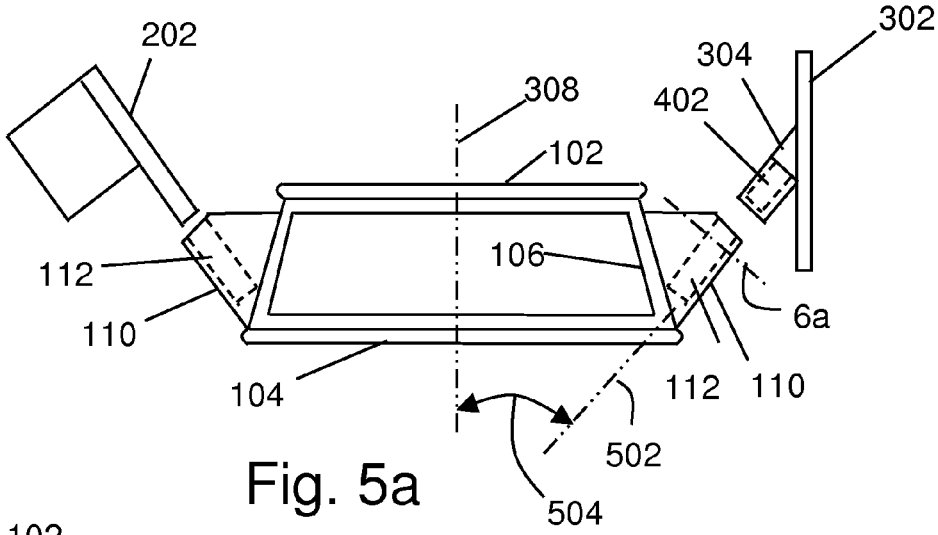
FIG. 5*a* illustrates a front view of the exemplary safety cone attachment module of FIG. 1.

FIG. 5*a* illustrates a front exploded view of the exemplary safety cone attachment module of FIG. 1 with the exemplary flag of FIG. 2 and sign of FIG. 3. Referring to FIG. 5*a*, a front view is shown of an embodiment having two attachment arms. The right arm is shown for attachment to a sign holder. The sign holder is coupled by inserting the mounting pin of the sign holder into the mounting hole of the right mounting arm. The alignment flange of the sign holder slides against the outside of the mounting arm to prevent rotation of the sign holder around the mounting arm axis. The left arm is shown for attachment to a flag by receiving a flag pole inserted into the mounting hole in the left arm.

A separation distance between the top ring 102 and bottom ring 104 is selected to provide the desired stability. A separation distance equal to the radius of the top ring is a good selection for many applications. Greater or lesser distances may be chosen, depending on the weight and balance loading of a given safety device to be attached. For example, long flag poles may require a longer separation distance to achieve the desired stability in windy conditions.

The mounting hole axis 502 is shown at a mounting hole angle 504. The mounting hole angle is measured between the cone center line axis 308 and the mounting hole axis 502. The mounting hole axis is typically in the plane with the cone center line. The cone center line runs through the center of the mounting surface circle defined by the upper ring 102 and lower ring 104. The mounting angle may be typically a suitable flag pole angle. The exemplary angle shown is approximately 45 degrees. The angle is preferably between 20 degrees and 70 degrees, more preferably between 30 degrees and sixty degrees. Note that in the embodiment shown, the lower surface of the mounting arm runs parallel to the mounting hole axis. In one embodiment, the mounting angle may have an upward component to allow the safety device to be held by gravity without needing additional fastening devices. Cross section 6*a* is shown in FIG. 6*a* for greater clarity and detail.

Figure 5B:
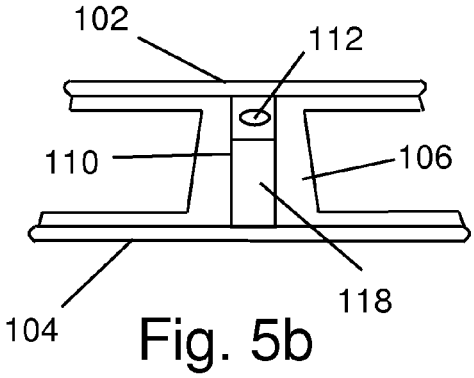
FIG. 5*b* illustrates a side view of the exemplary safety cone attachment module of FIG. 1.

FIG. 5*b* illustrates a side view of the exemplary safety cone attachment module of FIG. 1. FIG. 5*b* shows clearly the upper ring 102, lower ring 104, and spacing structure 106. The end view of the mounting arm 110 shows clearly the lower surface of the mounting arm 110 and mounting hole 112.

Figure 5C:
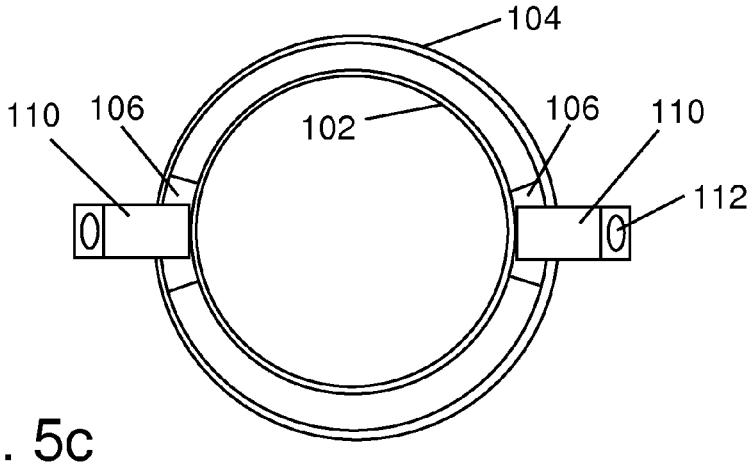
FIG. 5*c* illustrates a top view of the exemplary safety cone attachment module of FIG. 1.

FIG. 5*c* illustrates a top view of the exemplary safety cone attachment module of FIG. 1. Referring to FIG. 5*c*, the upper ring 102 and lower ring 104 are connected to the spacing structure 106. The attachment arm 110 is fixed to the spacing structure. The mounting arm upper surface and mounting hole 112 are visible in the top view.

Figure 6A:
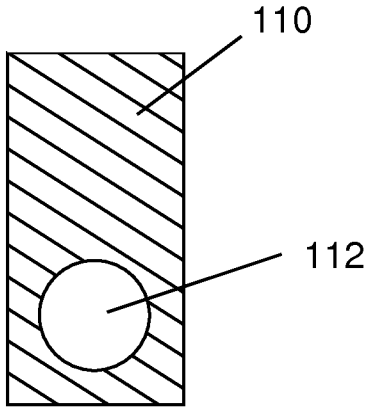
FIGS. 6*a* and 6*b* illustrate a cross section through the attachment arm structure of FIG. 5*a*.
Figure 6B:
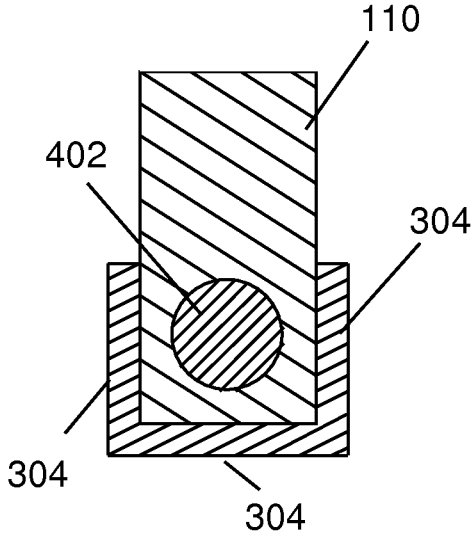

FIGS. 6*a* and 6*b* illustrate a cross section through the attachment arm structure of FIG. 5*a*. Referring to FIG. 6*a*, the cross section FIG. 6*a* is perpendicular to the mounting hole axis. In the view of FIG. 6*a*, the mounting arm 110 structure and the mounting hole 112 cross section can be seen.

FIG. 6*b* shows the cross section of FIG. 6*a* with the mounting features of the sign mounted on the mounting arm 110. Thus, the mounting rod 402 may be seen inserted into the mounting hole 112 and the mounting flanges 304 may be seen in contact with three sides of the mounting arm 110. The mounting flanges comprise three strips joined at the edges to form a channel. The channel 304 fits closely to the mounting arm 110 to prevent rotation and to establish a unique orientation (up/down) for the sign 302 (FIG. 3) or other safety feature mounted on the mounting arm 110.

Variations

As shown, two mounting arms are provided; however, one, two, three, four, or more may be provided as desired. The mounting arms as shown provide multiple advantages and the design lends itself to low cost fabrication. However other mounting attachment schemes may be provided as are known in the art.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An attachment module for a safety cone for mounting a safety enhancing device to said safety cone, said module comprising:

an upper ring configured for mounting on said safety cone at a first diameter of said safety cone;

a lower ring configured for mounting on said safety cone, said lower ring configured for mounting at a second diameter of said safety cone in accordance with a predetermined cone angle;

a connecting structure attached to said upper ring and attached to said lower ring, said connecting structure providing a separation distance between said first ring and said second ring in accordance with said first diameter and said second diameter and said predetermined cone angle; and an attachment arm attached to said connecting structure, said attachment arm capable of receiving a rod shaped attachment feature from said safety enhancement device for mounting said safety enhancement device on said attachment module;

said attachment module further including said safety enhancing device, said safety enhancing device having said rod shaped mounting feature attached to said safety enhancing device for mounting said safety enhancing device on said attachment module;

said attachment module further including at least one flange attached to said safety enhancing device, said at least one flange disposed parallel to said rod shaped mounting feature, said at least one flange configured to be close fitting to said mounting arm to establish a unique orientation of said safety enhancing device when mounted on said attachment module.

2. The attachment module in accordance with claim 1, wherein said at least one flange forms part of a channel shaped mounting feature, said channel shaped mounting feature configured to be close fitting to said mounting arm to establish a unique orientation of said safety enhancing device when mounted on said attachment module.

3. The attachment module in accordance with claim 2, wherein the safety enhancing device is a sign.

4. The attachment module in accordance with claim 1, wherein the safety enhancing device comprises a flag.

5. The attachment module in accordance with claim 1, wherein the safety enhancing device comprises a light.

6. The attachment module in accordance with claim 1, wherein the safety enhancing device comprises a tape holder.

7. The attachment module in accordance with claim 1, wherein the safety enhancing device comprises a flare.

8. The attachment module in accordance with claim 1, wherein said upper ring forms a round, a triangle, a square, a hexagon, or a polygon shape.

9. The attachment module in accordance with claim 1, wherein said attachment arm requires no fasteners to attach said safety enhancing device.

10. The attachment module in accordance with claim 1, wherein the attachment arm forms a mounting hole having a mounting hole axis, the mounting hole axis having a vertical directional component.

* * * * *